US011357293B2

(12) United States Patent
Hu et al.

(10) Patent No.: US 11,357,293 B2
(45) Date of Patent: Jun. 14, 2022

(54) WEARABLE DEVICES, WATCHBAND AND CONNECTOR

(71) Applicant: GUANGDONG OPPO MOBILE TELECOMMUNICATIONS CORP., LTD., Guangdong (CN)

(72) Inventors: Jianghua Hu, Guangdong (CN); Yuege Xue, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 0 days.

(21) Appl. No.: 16/886,248

(22) Filed: May 28, 2020

(65) Prior Publication Data

US 2020/0405017 A1 Dec. 31, 2020

(30) Foreign Application Priority Data

Jun. 25, 2019 (CN) ..... 201920968139.3

(51) Int. Cl.
*A44C 5/14* (2006.01)
*A44C 5/00* (2006.01)
*G04G 17/06* (2006.01)

(52) U.S. Cl.
CPC ..... *A44C 5/147* (2013.01); *A44C 5/0007* (2013.01); *A44C 5/0053* (2013.01); *G04G 17/06* (2013.01)

(58) Field of Classification Search
CPC ..... A44C 5/14; A44C 5/2057; A44C 5/147; A44C 5/0007; A44C 5/0053;
(Continued)

(56) References Cited

U.S. PATENT DOCUMENTS 6,014,793 A * 1/2000 Howald ..... A44C 5/147 24/115 G
10,058,148 B1 * 8/2018 Wittenberg ..... A44C 5/2057
(Continued)

FOREIGN PATENT DOCUMENTS

AT 10469 U1 * 4/2009 ..... G04B 37/1486
CN 104983142 A 10/2015
(Continued)

OTHER PUBLICATIONS

European search report, EP20178035 dated Nov. 25, 2020 (8 pages).
(Continued)

*Primary Examiner* — Jack W Lavinder
(74) *Attorney, Agent, or Firm* — Young Basile Hanlon & MacFarlane, P.C.

(57) ABSTRACT

A wearable device may include a watchcase defining a mounting slot and a key slot communicating with each other and a watchband. The watchband may include a strap-shaped body; and a clamping part connected to one end of the strap-shaped body and including a rotating part and a stop block arranged in the rotating part; the stop block is capable of moving out of or back into the rotating part; when the stop block moves into the rotating part, the clamping part is configured to be inserted into the mounting slot; after the clamping part is inserted into the mounting slot, the clamping part is configured to be rotated relative to the watchcase by rotating the watchband, and the stop block is configured to move out of the rotating part and is clamped in the key slot, such that the watchband is attached on the watchcase.

16 Claims, 12 Drawing Sheets

(58) Field of Classification Search
CPC ..... G04B 37/1493; G04B 37/1486; G04B 37/18; Y10T 24/4782; G04G 17/06
See application file for complete search history.

(56) References Cited

U.S. PATENT DOCUMENTS

| | | | | |
|---|---|---|---|---|
| 10,123,593 | B2 * | 11/2018 | Perkins | A44B 11/263 |
| 2005/0265132 | A1 * | 12/2005 | Ho | G04B 37/1486 368/282 |
| 2020/0390202 | A1 * | 12/2020 | Xue | A44C 5/14 |

FOREIGN PATENT DOCUMENTS

| | | | | |
|---|---|---|---|---|
| CN | 204682717 | U | 10/2015 | |
| CN | 206499033 | U | 9/2017 | |
| CN | 206760943 | U | 12/2017 | |
| CN | 107635429 | A | 1/2018 | |
| CN | 207870446 | U | 9/2018 | |
| CN | 108685288 | A | 10/2018 | |
| CN | 109452734 | A | 3/2019 | |
| EP | 1602990 | A2 * | 12/2005 | G04B 37/1486 |
| FR | 2881326 | A1 * | 8/2006 | A44C 5/14 |
| FR | 2881326 | A1 | 8/2006 | |
| WO | 2002005676 | A1 | 1/2002 | |

OTHER PUBLICATIONS

International Search Report, International application No. PCT/CN2020/093776, dated Aug. 31, 2020 (11 pages).
Indian Examination Report for IN Application 202014023401 dated Jul. 5, 2021. (5 pages).

* cited by examiner

WEARABLE DEVICES, WATCHBAND AND CONNECTOR

CROSS-REFERENCE TO RELATED APPLICATION(S)

The present application claims priority to Chinese Patent Application No. 201920968139.3, filed on Jun. 25, 2019, the contents of which are incorporated by reference in their entirety herein.

TECHNICAL FIELD

This disclosure relates to the technical field of wearable devices.

BACKGROUND

The watchcase usually includes watchband and watchcase, and the watchband is connected to the watchcase by elastic pins. The elastic pin is usually pointy and thin, so that it is not convenient for user to attach the watchband on the watchcase and detach the watchband from the watchcase.

SUMMARY

According to an aspect of the present disclosure, a wearable device is provided. The wearable device may include a watchcase defining a mounting slot and a key slot communicating with each other and a watchband. The watchband may include a strap-shaped body; and a clamping part connected to one end of the strap-shaped body and including a rotating part and a stop block arranged in the rotating part; the stop block is capable of moving out of or back into the rotating part; when the stop block moves into the rotating part, the clamping part is configured to be inserted into the mounting slot; after the clamping part is inserted into the mounting slot, the clamping part is configured to be rotated relative to the watchcase by rotating the watchband, and the stop block is configured to move out of the rotating part and is clamped in the key slot, such that the watchband is attached on the watchcase.

According to an aspect of the present disclosure, a watchband is provided. The watchband may include a trap-shaped body and a clamping part defining an accommodation room and connected to one end of the strap-shaped body, wherein the clamping part includes a fixing rod and a stop block; the fixing rod is inclined with respect to a width direction of the strap-shaped body, the stop block is accommodated in the accommodation room and configured to move out of or back into the accommodation room.

According to an aspect of the present disclosure, a connector may be provided. The connector may be configured to connect a strap-shaped body to a watchcase of a wearable device, including: a body configured to connect to one end of the strap-shaped body; and a clamping part connected to the body and configured to be inserted into a mounting slot of the watchcase along a length direction of the strap-shaped body; after the clamping part is inserted into the mounting slot, the clamping part is capable of rotating around the length direction of the strap-shaped body to be clamped in the mounting slot, such that the strap-shaped body is attached on the watchcase by the connector.

BRIEF DESCRIPTION OF DRAWINGS

In order to describe the technical solutions in the embodiments of the present disclosure more clearly, the drawings illustrative of the embodiments will be briefly described below. Obviously, the drawings in the following description only represent some embodiments of the present disclosure. For those of ordinary skill in the art, other drawings may also be obtained based on these drawings without any creativity.

DETAILED DESCRIPTION

Figure 1:
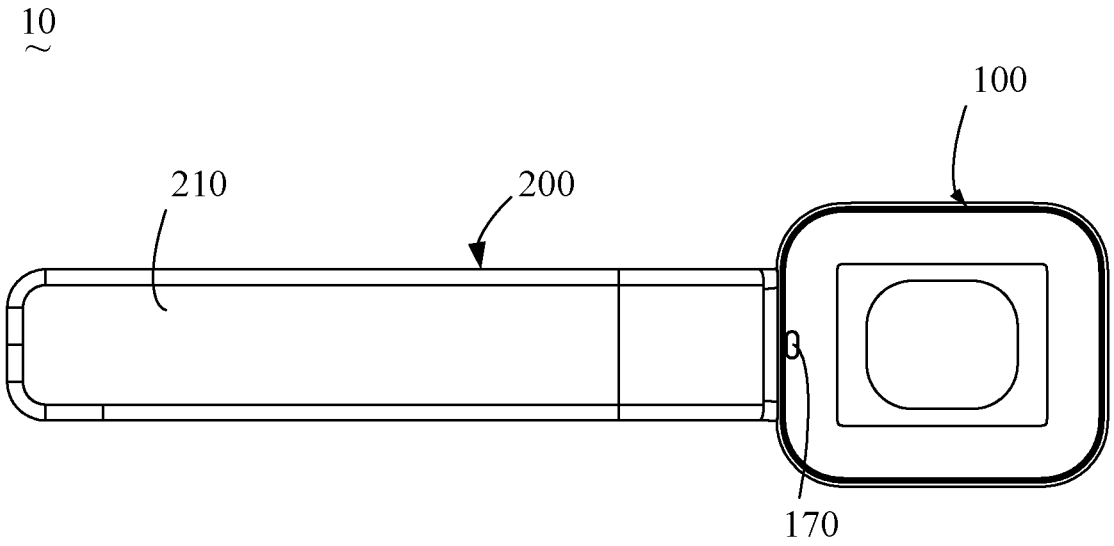
FIG. 1 is a rear view of a wearable device.

In order to facilitate understanding of the present application, the present application will be described more comprehensive below with reference to the related drawings. The drawings show the embodiments of the present application. However, this application can be implemented in many different forms and is not limited to the embodiments described herein. In contrast, these embodiments are provided to provide a thorough and comprehensive understanding of the disclosure of this application.

In an aspect of the present disclosure, an embodiment may provide a wearable device, which could solve the technical problem of not convenient for user to attach the watchband on the watchcase.

The wearable device may include: a watchcase defining a mounting slot and a key slot communicating with each other; a watchband including: a strap-shaped body; a clamping part connected to one end of the strap-shaped body, a stop block is arranged on the clamping part; the stop block is retractable; when the stop block is accommodated in the clamping part, the clamping part is capable of being inserted into the mounting slot; after the clamping part is inserted into the mounting slot, the clamping part rotates relative to the watchcase by rotating the watchband, the stop block is capable of extending out of the clamping part and is clamped in the key slot, such that the watchband is attached on the watchcase.

The above wearable device having a mounting slot and a key slot communicating with each other defined in the watchcase; the watchband include a clamping part, the clamping part is inserted into the mounting slot and rotated in the mounting slot, such that the stop block could be clamped in the key slot, therefore the watchband is attached on the watchcase. The attachment of the watchband is convenient, which could bring better experience to users.

In some embodiments, further including a key received in the key slot; the key is movable relative to the key slot and configured to press the stop block to move out of the key slot, such that the watchband is detached from the watchcase by rotating the watchband after the stop block is accommodated in the clamping part.

In some embodiments, a first elastic unit is arranged in the key slot; one end of the first elastic unit abuts against the watchcase, and the other end of the first elastic unit abuts against the key; when the watchband is attached on the watchcase, the key is configured to be pressed to move into the key slot to compress the first elastic unit and push the stop block to move out of the key slot.

In some embodiments, the watchcase further may include a side frame; the mounting slot may include a first mounting slot and a second mounting slot communicating with each other; the first mounting slot extends to the outer surface of the side frame, and the second mounting slot is defined by the bottom of the first mounting slot; the clamping part may include a rotating part and a fixing rod fixed on the rotating part; the rotating part is fixed on the strap-shaped body, and the fixing rod is inclined to a width direction of the strap-shaped body; the fixing rod is configured to enter the second mounting slot by passing through the first mounting slot along a length direction of the strap-shaped body; and after the fixing rod enters the second mounting slot, the watchband is capable of rotating around the length of the strap-shaped body, such that the fixing rod is limited in the second mounting slot to prevent the watchband from falling off from the second mounting slot.

In an aspect of the present disclosure, a wearable device may be provided. The wearable device may include a watchcase defining a mounting slot and a key slot communicating with each other; a watchband including a strap-shaped body; and a clamping part connected to one end of the strap-shaped body and including a rotating part and a stop block arranged in the rotating part; the stop block is capable of moving out of or back into the rotating part; when the stop block moves into the rotating part, the clamping part is configured to be inserted into the mounting slot; after the clamping part is inserted into the mounting slot, the clamping part is configured to be rotated relative to the watchcase by rotating the watchband, and the stop block is configured to move out of the rotating part and is clamped in the key slot, such that the watchband is attached on the watchcase.

In some embodiments, the watchcase may include a key received in the key slot; the key is movable relative to the key slot and configured to press the stop block to move out of the key slot, such that the watchband is detached from the watchcase by rotating the watchband after the stop block is accommodated in the rotating part.

In some embodiments, the watchcase further may include a first elastic unit arranged in the key slot; one end of the first elastic unit abuts against a side wall of the key slot, and the other end of the first elastic unit abuts against the key; when the watchband is attached on the watchcase, the key is configured to be pressed to move into the key slot to compress the first elastic unit and push the stop block to move out of the key slot.

In some embodiments, the watchcase further may include a side frame including an outer surface and defining the mounting slot; the mounting slot may include a first mounting slot and a second mounting slot communicating with each other; the first mounting slot extends to the outer surface of the side frame, and the second mounting slot is defined by the bottom of the first mounting slot; the clamping part further may include a fixing rod fixed on the rotating part; the rotating part is fixed on the strap-shaped body, and the fixing rod is inclined to a width direction of the strap-shaped body; the fixing rod is configured to enter the second mounting slot by passing through the first mounting slot along a length direction of the strap-shaped body; and after the fixing rod enters the second mounting slot, the watchband is capable of rotating around the length of the strap-shaped body, such that the fixing rod rotates and is limited in the second mounting slot to prevent the watchband from falling off from the second mounting slot.

In some embodiments, the mounting slot further may include a third mounting slot; the third mounting slot is defined by a side wall of the first mounting slot and extends to the outer surface of the side frame; the key slot is communicated with the third mounting slot; in the process of the fixing rod passing through the first mounting slot and entering the second mounting slot, a part of the rotating part is received in the third mounting slot, and the rotating part is rotatable in the third mounting slot.

In some embodiments, the clamping part further may include a second elastic unit; the stop block and the second elastic unit are received in the rotating part; the second elastic unit is configured to drive the stop block to move out of the rotating part; and the stop block could move back into the rotating part, such that the fixing rod enters the second mounting slot by passing through the first mounting slot; the fixing rod is configured to be rotated around the length direction of the strap-shaped body by rotating the watchband, such that the stop block moves out of and is accommodated in the key slot, and the fixing rod is clamped by a side wall of the second mounting slot close to the first mounting slot.

In some embodiments, the clamping part further may include a second elastic unit received in the rotating part; the second elastic unit is configured to drive the stop block to move out of the rotating part; the fixing rod is configured to be rotated around the length direction of the strap-shaped body by rotating the watchband, such that the stop block moves out of the rotating part and is accommodated in the key slot, and the fixing rod is clamped by a side wall of the second mounting slot close to the first mounting slot.

In some embodiments, the clamping part further may include a top block, a second elastic unit, and a third elastic unit; the top block, the second elastic unit, and the third elastic unit are arranged in the rotating part; the stop block is located arranged on the rotating part; one end of the third elastic unit abuts against the rotating part, and the other end of the third elastic unit abuts against the top block; the third elastic unit is configured to drive the top block to protrude out of the rotating part; one end of the second elastic unit abuts against the top block, and the other end abuts against the stop block; the top block is configured to drive the stop block to move out of or back into the rotating part through the second elastic unit; in the process of the fixing rod passing through the first mounting slot, the side wall of the third mounting slot presses the top block to make the top block move back into the rotating part; when the fixing rod is received in the second mounting slot, the fixing rod is configured to be rotated around the length direction of the strap-shaped body by rotating the watchband, such that the stop block moves out of the rotating part and is accommodated in the key slot, and the fixing rod is clamped by a side wall of the second mounting slot close to the first mounting slot.

In some embodiments, the clamping part further may include a top block, a second elastic unit, and a third elastic unit; the top block, the second elastic unit, and the third elastic unit are arranged in the rotating part; one end of the third elastic unit abuts against a wall of the rotating part, and the other end of the third elastic unit abuts against the top block; the third elastic unit is configured to drive the top block to protrude out of the rotating part; one end of the second elastic unit abuts against the top block, and the other end abuts against the stop block; the top block is configured to drive the stop block to move out of or back into the rotating part through the second elastic unit; in the process of the fixing rod passing through the first mounting slot, the side wall of the third mounting slot presses the top block to make the top block move back into the rotating part; when the fixing rod is received in the second mounting slot, the fixing rod is configured to be rotated around the length direction of the strap-shaped body by rotating the watchband, such that the stop block moves out of the rotating part and is accommodated in the key slot, and the fixing rod is clamped by a side wall of the second mounting slot close to the first mounting slot.

In some embodiments, the rotating part defines an accommodation room; the rotating part further defines a first through hole communicated with the accommodation room, the first through hole extends from the accommodation room to an outer surface of the rotating part;

the top block may include a first base part and a first protruding part connected to the first base; the first base part is accommodated in the accommodation room, and the first protruding part is received in the first through hole and movable in the first through hole, such that the first protruding part moves out of or back into the rotating part.

In some embodiments, a structure of the first protruding part capable of moving out of or back into the rotating part through the first through hole has a smooth transition structure.

In some embodiments, the rotating part further defines a second through hole communicated with the accommodation room and extending from the accommodation room to an outer surface of the rotating part; the first through hole and the second through hole are located on two opposite sides of the rotating part; the stop block may include a second base part and a second protruding part connected to the second base part; the second base part is accommodated in the accommodation room, and the second protruding part is received in the second through hole and movable in the second through hole, such that the second protruding part moves out of or back into the rotating part.

In some embodiments, the rotating part further may include a first pillar accommodated in the accommodation room, one end of the third elastic unit is wrapped on the first pillar, and the other end of the third elastic unit abuts against the first base part.

In some embodiments, the rotating part defines an accommodation room and a first through hole communicated with the accommodation room, the first through hole extends from the accommodation room to an outer surface of the rotating part; the top block may include a first base part and a first protruding part connected to the first base; the first base part is accommodated in the accommodation room, and the first protruding part is received in the first through hole and movable in the first through hole, such that an end of the first protruding part moves out of or back into the rotating part through first through hole.

In some embodiments, the end of the first protruding part capable of moving out of or back into the rotating part through the first through hole has a smooth transition structure.

In some embodiments, the rotating part further defines a second through hole communicated with the accommodation room and extending from the accommodation room to an outer surface of the rotating part; the first through hole and the second through hole are located on two opposite sides of the rotating part; the stop block may include a second base part and a second protruding part connected to the second base part; the second base part is accommodated in the accommodation room, and the second protruding part is received in the second through hole and movable in the second through hole, such that an end of the second protruding part moves out of or back into the rotating part through the second through hole.

In some embodiments, the rotating part further may include a first pillar accommodated in the accommodation room, the end of the third elastic unit abutting against the rotating part is wrapped on the first pillar, and the other end of the third elastic unit abuts against the first base part.

In an aspect of the present disclosure, an embodiment may provide a watchband, which could solve the technical problem of not convenient for user to attach the watchband on the watchcase.

The watchband may include: a trap-shaped body; a clamping part connected to one end of the strap-shaped body, the clamping part may include a fixing rod and a stop block; the fixing rod is inclined with respect to a width direction of the strap-shaped body, the stop block is accommodated in the clamping part and configured to protrude out of the clamping part.

The above watchband includes a clamping part, the clamping part includes a fixing rod and a stop block, the fixing rod is inclined, and the stop block is capable of move out or back into the clamping part, such that the watchband could be attached to the watchcase conveniently, which could bring better experience to users.

In some embodiments, the clamping part further may include a rotating part and a second elastic unit; the rotating part is fixed on the strap-shaped body; the fixing rod is fixed on the rotating part; the stop block and the second elastic unit are located on the clamping part, and the second elastic unit is configured to drive the stop block to move out of the clamping part.

In some embodiments, the clamping part further may include a rotating part, a top block, a second elastic unit, and a third elastic unit; the rotating part is fixed on the strap-shaped body; the fixing rod is fixed on the rotating part; the top block, the stop block, the second elastic unit, and the third elastic unit are arranged in the rotating part; one end of the third elastic unit abuts against the rotating part, the other end of the third elastic unit abuts against the top block, the third elastic unit is configured to drive the top block to move out of the rotating part; one end of the second elastic unit abuts against the top block, and the other end of the second elastic unit abuts against the stop block, the second elastic unit is configured to drive the stop block to move out of or back into the rotating part.

In some embodiments, the rotating part further defines an accommodation room and a first through hole communicating with the accommodation room; the top block may include a first base part and a first protruding part connected to the first base part; the first base part is accommodated in the accommodation room, and the first protruding part is received in the first through hole and movable in the first through hole, such that the first protruding part moves out of or back into the rotating part.

In some embodiments, a structure of the first protruding part capable of moving out of or back into the rotating part has a smooth transition structure.

In some embodiments, the rotating part further may include a second through hole communicating with the accommodation room and extending from the accommodation room to an outer surface of the rotating part; the first through hole and the second through hole are located on two opposite sides of the rotating part; the stop block may include a second base part and a second protruding part connected to the second base part; the second base part is accommodated in the accommodation room, and the second protruding part is received in the second through hole and movable in the second through hole, so that the second protruding part moves out of or back into the rotting part.

In some embodiments, the rotating part further may include a first pillar accommodated in the accommodation room, one end of the third elastic unit is wrapped on the first pillar, and the other end of the third elastic unit abuts against the first base part.

In an aspect of the present disclosure, a watchband including a trap-shaped body; a clamping part defining an accommodation room and connected to one end of the strap-shaped body, the clamping part may include a fixing rod and a stop block; the fixing rod is inclined with respect to a width direction of the strap-shaped body, the stop block is accommodated in the accommodation room and configured to move out of or back into the accommodation room.

In some embodiments, the clamping part further may include a rotating part and a second elastic unit; the rotating part is fixed on the strap-shaped body; the fixing rod is fixed on the rotating part; the accommodation room is defined by the clamping part, and the second elastic unit is accommodated in the accommodation room and configured to drive the stop block to move out of the clamping part.

In some embodiments, the clamping part further may include a rotating part, a top block, a second elastic unit, and a third elastic unit; the rotating part is fixed on the strap-shaped body; the fixing rod is fixed on the rotating part; the accommodation room is defined by the rotating part, and the top block, the second elastic unit, and the third elastic unit are accommodated in the accommodation room; one end of the third elastic unit abuts against a side wall of the rotating part, the other end of the third elastic unit abuts against the top block, the third elastic unit is configured to drive the top block to move out of the accommodation room; one end of the second elastic unit abuts against the top block, and the other end of the second elastic unit abuts against the stop block, the second elastic unit is configured to drive the stop block to move out of or back into the rotating part.

In some embodiments, the rotating part further defines a first through hole communicating with the accommodation room; the top block may include a first base part and a first protruding part connected to the first base part; the first base part is accommodated in the accommodation room, and the first protruding part is received in the first through hole and movable in the first through hole, such that an end of the first protruding part moves out of or back into the rotating part through the first through hole.

In some embodiments, the rotating part further may include a second through hole communicating with the accommodation room and extending from the accommodation room to an outer surface of the rotating part; the first through hole and the second through hole are located on two opposite sides of the rotating part; the stop block may include a second base part and a second protruding part connected to the second base part; the second base part is accommodated in the accommodation room, and the second protruding part is received in the second through hole and movable in the second through hole, so that an end of the second protruding part moves out of or back into the rotting part.

In a third aspect of the present disclosure, an embodiment may provide a wearable device, which could solve the technical problem of not convenient for user to attach the watchband on the watchcase.

The wearable device may include: a watchcase defining a mounting slot; a watchband including: a strap-shaped body; a clamping part connected to one end of the strap-shaped body, the clamping part is configured to be inserted into the mounting slot along a length direction of the strap-shaped body; after the clamping part is inserted into the mounting slot, the watchband is capable of rotating around the length direction of the strap-shaped body, such that the clamping part is clamped in the mounting slot, and the watchband is attached on the watchcase.

The above wearable device having a mounting slot and a key slot communicating with each other defined in the watchcase; the watchband include a clamping part, the clamping part is inserted into the mounting slot and rotated in the mounting slot, such that the stop block could be clamped in the key slot, therefore the watchband is attached on the watchcase. The attachment of the watchband is convenient, which could bring better experience to users.

In some embodiments, the watchcase further defines a key slot communicating with the mounting slot; the mounting slot may include a first mounting slot and a second mounting slot communicating with each other; the first mounting slot extends to an outer surface of the watchcase, and the second mounting slot is define by a bottom of the first mounting slot; and a cross-sectional area of the second mounting slot is larger than a cross-sectional area of the first mounting slot; the clamping part may include a fixing rod, a rotating part, and a stop block; the stop block is configured to move relative to the rotating part; the rotating part is fixed on the strap-shaped body; the fixing rod is fixed on the rotating part and is inclined with respect to a width direction of the strap-shaped body; the fixing rod is configured to move along the length direction of the strap-shaped body and enter the second mounting slot by passing through the first mounting slot; when the fixing rod is received in the second mounting slot, the watchband is capable of rotating around the length direction of the strap-shaped body, such that the fixing rod is limited in the second mounting slot along the length direction of the strap-shaped body, and the stop block protrudes from the rotating part and is clamped in the key slot.

In some embodiments, the mounting slot further may include a third mounting slot; the third mounting slot is defined by a side wall of the first mounting slot and extends to the outer surface of the watchcase; the key slot is defined by a side wall of the third mounting slot and communicated to the third mounting slot; when the fixing rod is received in the second mounting slot and the watchband rotates around the length direction of the strap-shaped body, the rotating part is rotated in the third mounting slot.

In some embodiments, the clamping part may include a second elastic unit arranged on the rotating part; the stop block is arranged on the rotating part; the second elastic unit abuts against the stop block and is configured to drive the stop block to move to protrude out of the rotating part; the stop block is capable of moving back into the rotating part, such that the fixing rod is inserted to the second mounting slot by passing the first mounting slot; the fixing rod is rotated around the length direction of the strap-shaped body by rotating the watchband, such that the stop block protrudes out of the rotating part and is accommodated in the key slot, and the fixing rod is clamped by a side wall of the second mounting slot close to the first mounting slot.

In some embodiments, the clamping part may include a top block, a second elastic unit, and a third elastic unit; the top block, the second elastic unit, and the third elastic unit are arranged on the rotating part; the stop block is arranged on the rotating part; one end of the third elastic unit abuts against the rotating part, and the other end of the third elastic unit abuts against the top block, the third elastic unit is configured to drive the top block to protrude out of the rotating part; one end of the second elastic unit abuts against the top block, and the other end of the second elastic unit abuts against the stop block; the top block is configured to drive the stop block to move through the second elastic unit, so that the stop block move out of or back into the rotating part; when the fixing rod passes through the first mounting slot, the side wall of the third mounting slot presses the top block, so that the top block moves back into the rotating part and push the stop block through the second elastic unit; when the fixing rod is received in the second mounting slot, the fixing rod is configured to be rotated around the length direction of the strap-shaped body by rotating the watchband, so that the stop block protrudes out of the rotating part and is accommodated in the key slot, and the clamping part is clamped by the side wall of the second mounting slot close to the first mounting slot.

In some embodiments, the rotating part defines a accommodation room, a first through hole, and a second through hole; the first through hole and the second through hole are communicated with the accommodation room; the top block is communicated in the accommodation room and capable of moving out of or back into the accommodation room through the first through hole; and the stop block is communicated in the accommodation room and capable of moving out of or back into the accommodation room through the second through hole.

In some embodiments, a structure of the top block capable of moving out of or back into the accommodation room has a smooth transition structure.

In some embodiments, further including a key received in the key slot; the key is movable in the key slot and configured to press the stop block to move out of the key slot, such that the watchband is detached from the watchcase by rotating the watchband after the stop block is accommodated in the clamping part.

In an aspect of the present disclosure, a connector may be provided. The connector may be configured to connect a strap-shaped body to a watchcase of a wearable device and including: a body configured to connect to one end of the strap-shaped body; and a clamping part connected to the body and configured to be inserted into a mounting slot of the watchcase along a length direction of the strap-shaped body; after the clamping part is inserted into the mounting slot, the clamping part is capable of rotating around the length direction of the strap-shaped body to be clamped in the mounting slot, such that the strap-shaped body is attached on the watchcase by the connector.

In some embodiments, the watchcase further defines a key slot communicating with the mounting slot; the mounting slot may include a first mounting slot and a second mounting slot communicating with each other; the first mounting slot extends to an outer surface of the watchcase, and the second mounting slot is define by a bottom of the first mounting slot; and a cross-sectional area of the second mounting slot is larger than a cross-sectional area of the first mounting slot; the clamping part may include: a rotating part fixed on the strap-shaped body; a fixing rod fixed on the rotating part and is inclined with respect to a width direction of the strap-shaped body, the fixing rod is configured to move along the length direction of the strap-shaped body and enter the second mounting slot by passing through the first mounting slot; and a stop block arranged on the rotating part, the stop block is configured to move relative to the rotating part; when the fixing rod is received in the second mounting slot, the clamping part is capable of rotating around the length direction of the strap-shaped body, such that the fixing rod is limited in the second mounting slot along the length direction of the strap-shaped body, and the stop block protrudes from the rotating part and is clamped in the key slot.

In some embodiments, the mounting slot further may include a third mounting slot; the third mounting slot is defined by a side wall of the first mounting slot and extends to the outer surface of the watchcase; the key slot is defined by a side wall of the third mounting slot and communicated to the third mounting slot; when the fixing rod is received in the second mounting slot and the clamping part rotates around the length direction of the strap-shaped body, the rotating part is rotated in the third mounting slot; the clamping part may include a second elastic unit arranged on the rotating part; the second elastic unit abuts against the stop block and is configured to drive the stop block to move to protrude out of the rotating part; the stop block is capable of moving back into the rotating part, such that the fixing rod is inserted to the second mounting slot by passing the first mounting slot; the fixing rod is rotated around the length direction of the strap-shaped body by rotating the clamping part, such that the stop block protrudes out of the rotating part and is accommodated in the key slot, and the fixing rod is clamped by a side wall of the second mounting slot close to the first mounting slot.

In some embodiments, the mounting slot further may include a third mounting slot; the third mounting slot is defined by a side wall of the first mounting slot and extends to the outer surface of the watchcase; the key slot is defined by a side wall of the third mounting slot and communicated to the third mounting slot; when the fixing rod is received in the second mounting slot and the clamping part rotates around the length direction of the strap-shaped body, the rotating part is rotated in the third mounting slot; the clamping part may include a top block, a second elastic unit, and a third elastic unit; the top block, the second elastic unit, and the third elastic unit are arranged on the rotating part; one end of the third elastic unit abuts against a wall of the rotating part, and the other end of the third elastic unit abuts against the top block, the third elastic unit is configured to drive the top block to protrude out of the rotating part; one end of the second elastic unit abuts against the top block, and the other end of the second elastic unit abuts against the stop block; the top block is configured to drive the stop block to move through the second elastic unit, so that the stop block move out of or back into the rotating part; when the fixing rod passes through the first mounting slot, the side wall of the third mounting slot presses the top block, so that the top block moves back into the rotating part and push the stop block through the second elastic unit; when the fixing rod is received in the second mounting slot, the fixing rod is configured to be rotated around the length direction of the strap-shaped body by rotating the clamping part, so that the stop block protrudes out of the rotating part and is accommodated in the key slot, and the clamping part is clamped by the side wall of the second mounting slot close to the first mounting slot.

Figure 2:
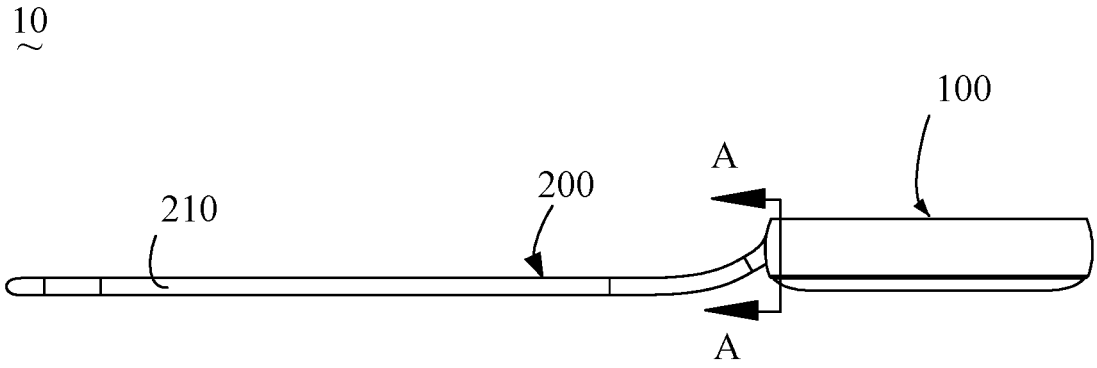
FIG. 2 is a side view of the wearable device as shown in FIG. 1.
Figure 3:
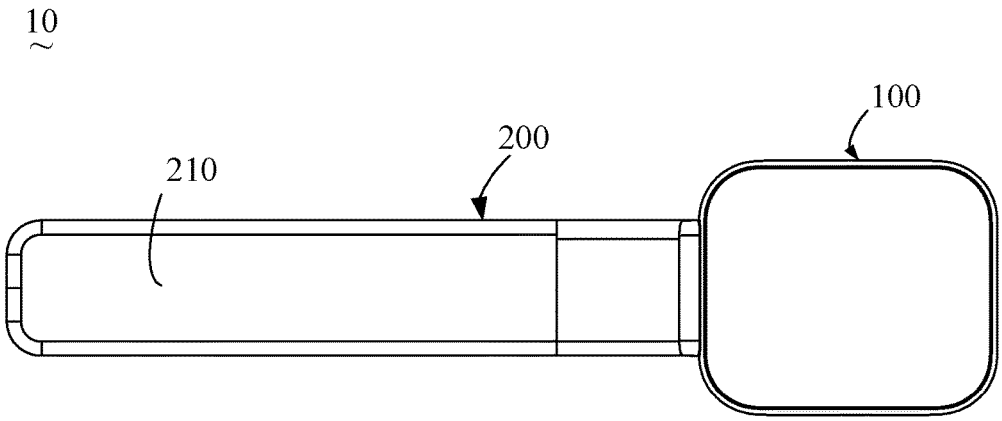
FIG. 3 is a main view of the wearable device as shown in FIG. 1.

Referring to FIG. 1 to FIG. 3, in some embodiments, the wearable device 10 may include a watchcase 100 and a watchband 200. The watchcase 100 could be made of non-metallic materials such as plastic, rubber, silicone, wood or ceramic. The watchcase 100 could also be made of metal materials such as stainless steel, aluminum alloy or magnesium alloy. In some embodiments, the wearable device 10 may be a smart watch, and the watchcase 100 defines an installation room inside of the watchcase 100 and configured to accommodate the electronic components such as batteries, processors, display 110, biosensors, etc. However, the display 110 is not necessary, so the display 110 could be omitted. The biosensor could be used to detect biological data such as heart rate, respiratory rate, blood pressure or body fat, etc. In some embodiments, the biosensor could also be used to detect motion state of the user such as step counting. In some embodiments, the wearable device 10 may be a sports watchcase or a conventional watch. The sports watch may be usually an electronic watch, and the conventional watch may be usually a mechanical watch. In some embodiments, the wearable device 10 could also be a smart bracelet, etc.

Figure 4:
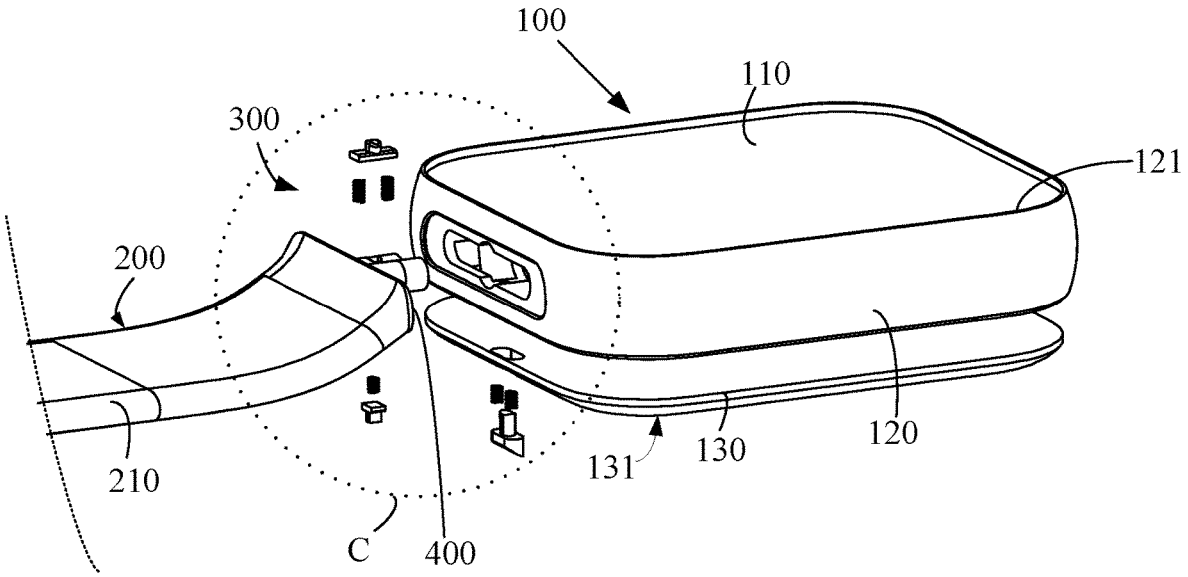
FIG. 4 is an exploded view of the wearable device as shown in FIG. 1.
Figure 5:
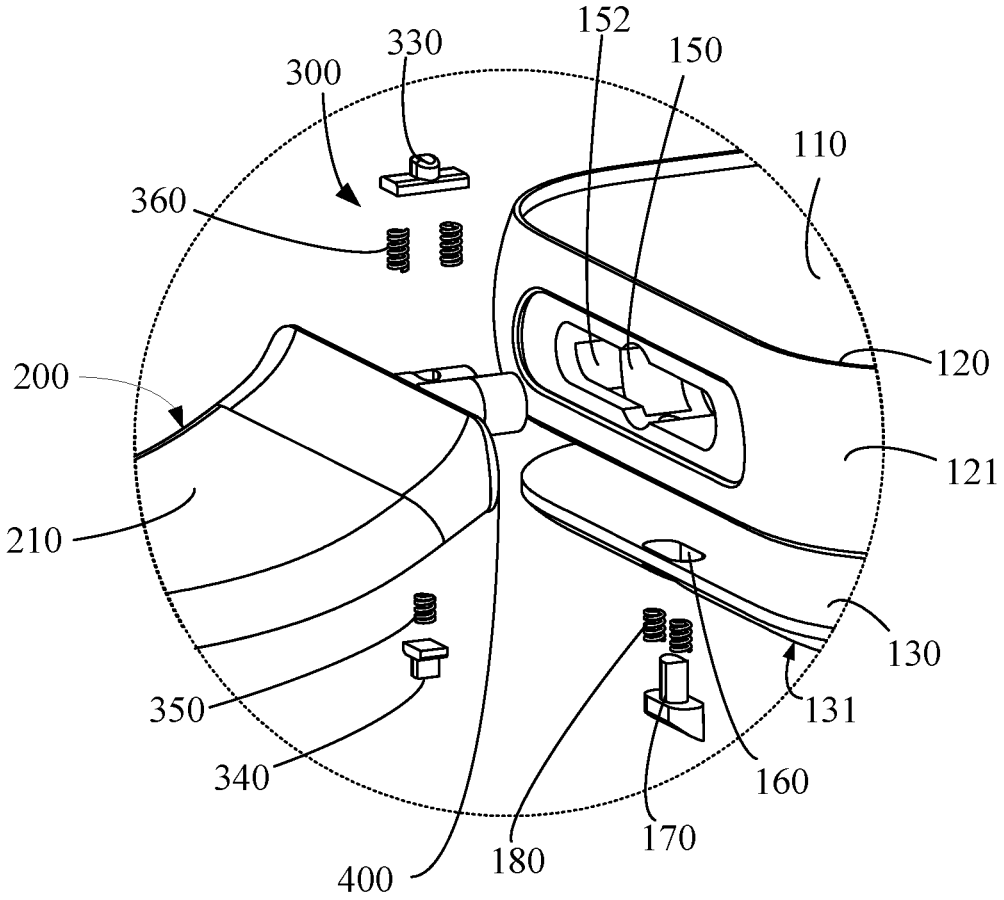
FIG. 5 is an enlarged view of a part C of the wearable device as shown in FIG. 4.

Referring to FIG. 4 and FIG. 5, in some embodiments, the watchband 200 may include a strap-shaped body 210 and a clamping part 300 connected to the strap-shaped body 210. In some embodiments, clamping part 300 may be connected to a body 400 to form a connector. The connector is configured to connect the watchband 200 to the watchcase 100. The clamping part 300 may be connected to the strap-shaped body 210 by the body 400. The watchcase 100 may define a mounting slot 150 configured for installing the clamping part 300. The clamping part 300 could be installed in the mounting slot 150 and could be separated from the mounting slot 150. In some embodiments, the watchband 200 is divided into two sections (two-sections structure). One end of each of the two sections of the watchband 200 may be connected to the watchcase 100, and the other ends of the two sections of the watchband 200 away from the watchcase 100 could be buckled together so that the watchband 200 and the watchcase 100 to form a loop, so that the wearable device 10 could be worn on the user's wrist or upper arm or other part of the user's body by the watchband 200. In some embodiments, the watchband 200 could be a single strap-shaped structure having two opposite ends, and the two opposite ends of the watchband 200 could be respectively connected to the watchcase 100. The size of the loop including the watchband 200 could be adjusted by means of other structures such as a clasp etc, so that it is convenient for the user to wear the smart watch. This application is illustrated by using one of the two sections of the watchband 200. However, it may be understood that the watchband 200 with any other structure may be applicable to the wearable device 10 of present application. In some embodiments of the present application, the watchband 200 may be a sheet-shaped structure. In some embodiments, the watchband 200 could also be of cylindrical structure or the like. It is defined that, after the watchband 200 is unfolded in flattened form, the length direction of the watchband 200 may be the length direction of the wearable device 10, the width direction of the watchband 200 may be the width direction of the wearable device 10, and the thickness direction of the watchband 200 may be the thickness direction of the wearable device 10.

Figure 6:
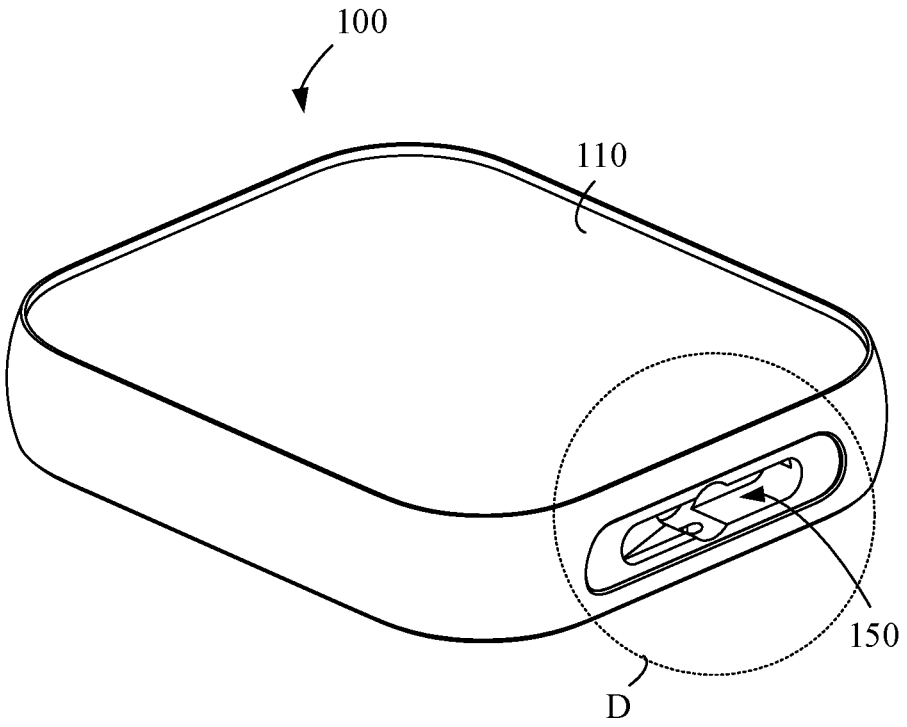
FIG. 6 is a perspective view of a watchcase of the wearable device as shown in FIG. 1.
Figure 7:
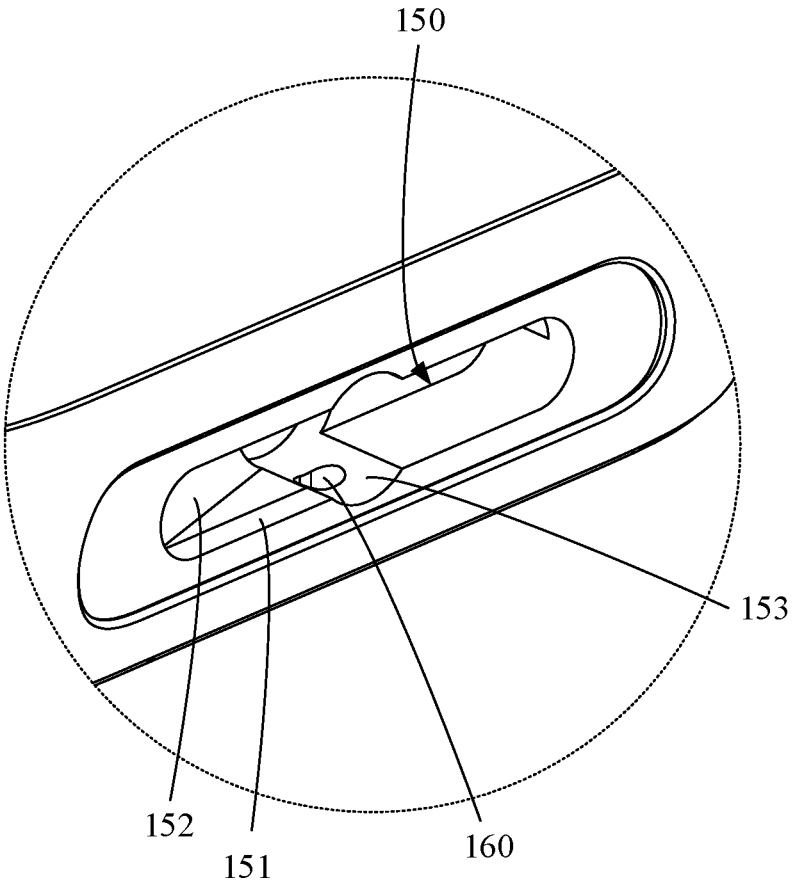
FIG. 7 is an enlarged view of a part D of the watchcase as shown in FIG. 6.

Referring to FIG. 5 to FIG. 7, in some embodiments, the watchcase 100 may include a display screen 110, a back shell 130 and a side frame 120. The display screen 110 and the back shell 130 are installed on two opposite sides of the side frame 120. The display screen 110, the back shell 130 and the side frame 120 together assembled to form the watchcase 100 and define the installation room of the watchcase 100. The main board, battery and other electronic components of the wearable device 10 are located in the installation room of the watchcase 100. The outer surface of the side frame 120 may be defined as a side surface 121, and the surface of the back shell 130 opposite to the display screen 110 may be defined as a rear surface 131. The watchcase 100 may define a mounting slot 150 and a key slot 160 communicating with each other. The mounting slot 150 extends to the side surface 121, and the key slot 160 extends to the rear surface 131. It could be understood that the depth direction of the mounting slot 150 may be vertical or substantially vertical to the depth direction of the key slot 160. A key 170 that could be pressed by the user may be located in the key slot 160. When the clamping part 300 may be installed in the mounting slot 150, the clamping part 300 could be detached from the mounting slot 150 by pressing the key 170.

Figure 8:
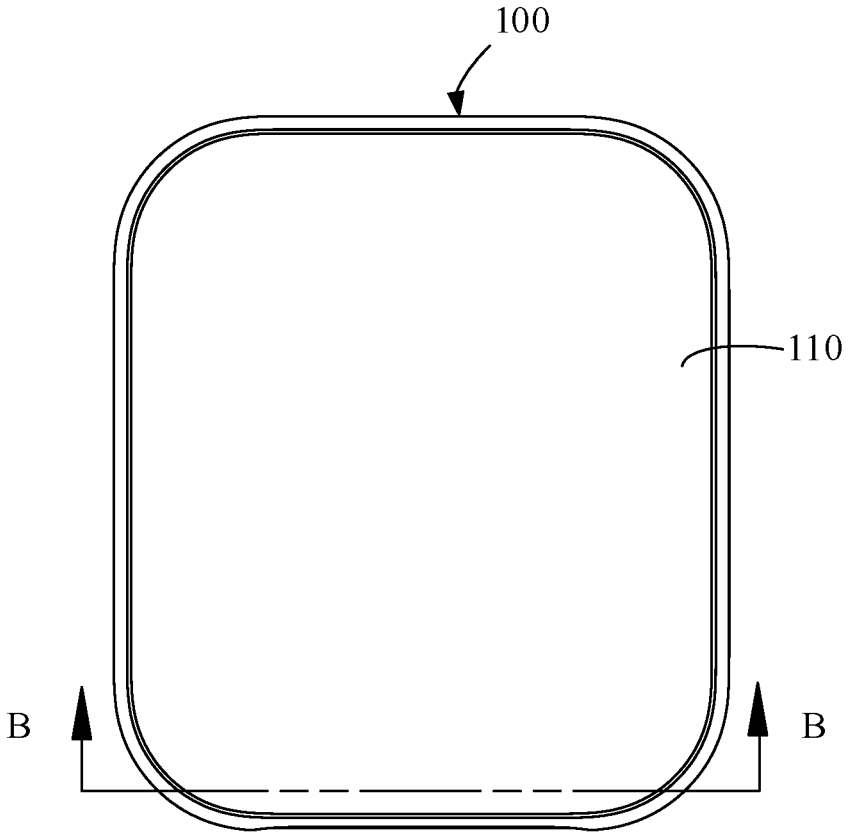
FIG. 8 is the main view of the watchcase as shown in FIG. 6.
Figure 9:
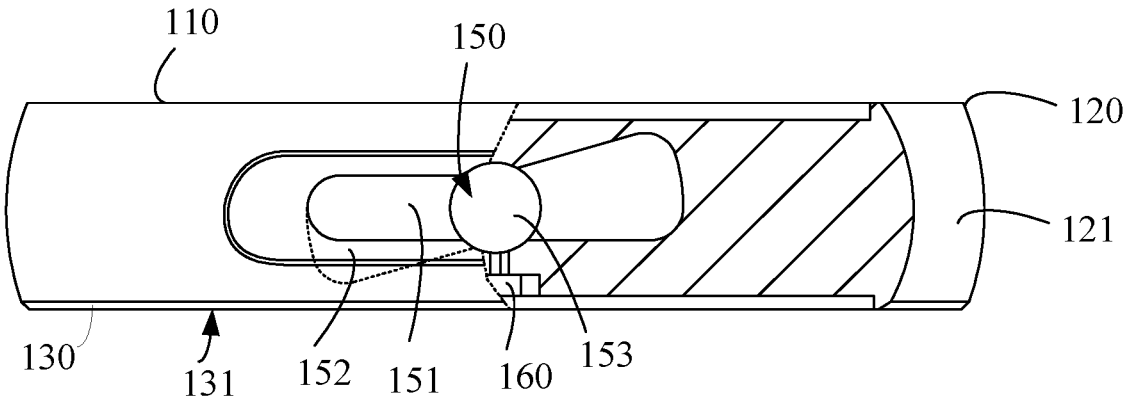
FIG. 9 is a sectional view along line B-B of the watchcase as shown in FIG. 8.

Referring to FIG. 5 to FIG. 7, in some embodiments, the mounting slot 150 may define a first mounting slot 151, a second mounting slot 152 and a third mounting slot 153 communicating with each other. The first mounting slot 151 may extend to the side surface 121, and the second mounting slot 152 may be located on the side of the first mounting slot 151 away from the side surface 121. That is, the second mounting slot 152 may be defined by the bottom of the first mounting slot 151. Both the depth direction of the second mounting slot 152 and the depth direction of the first mounting slot 151 are the same as the length direction of the wearable device 10, so that the second mounting slot 152 and the first mounting slot 151 are substantially aligned with each other. As shown in FIG. 8 and FIG. 9, the cross-sectional area of the second mounting slot 152 may be larger than the cross-sectional area of the first mounting slot 151, so that a part of the clamping part 300 could pass through the first mounting slot 151 and be located in the second mounting slot 152. The part of the clamping part 300 could also be rotated in the second mounting slot 152 relative to the watchcase 100 and clamped in the second mounting slot 152, so that the clamping part 300 is prevented from falling off from the second mounting slot 152. The third mounting slot 153 also extends along the length direction of the wearable device 10 and extends to the side surface 121 by passing through both the first mounting slot 151 and the second mounting slot 152. The key slot 160 may be intercommunicated with the third mounting slot 153 and extends from the third mounting slot 153 to the rear surface 131. When the user presses the key 170, the key 170 could touch the clamping part 300, so that the clamping part 300 could be detached from the mounting slot 150.

As shown in FIG. 7 and FIG. 9, the third mounting slot 153 may be located in the middle of the first mounting slot 151 and the second mounting slot 152, so that each of the first mounting slot 151 and the second mounting slot 152 is substantially symmetrical with respect to the third mounting slot 153. The second mounting slot 152 may include a first side wall near to the back shell 130 and a second side wall opposite to the first side wall and near to the display screen 110. Along the width direction of the wearable device 10, a first part of the second mounting slot 152 is located on a first side of the third mounting slot 153, and a second part of the second mounting slot 152 is located on a second side of the third mounting slot 153 opposite to the first side. On the first side of the third mounting slot 153, the first side wall of the second mounting slot 152, that is near to the back shell 130, is flush with the side wall of the first mounting slot 151; and the second side wall of the second mounting slot 152, that is near to the display screen 110, is sunken toward the display screen 110 relative to the side wall of the first mounting slot 151; so that the cross-sectional area of the second mounting slot 152 is larger than the cross-sectional area of the first mounting slot 151, namely the space of the second mounting slot 152 is larger than the space of the first mounting slot 151. One the second side of the third mounting slot 153, the second side wall of the second mounting slot 152, that is near to the display screen 110, is flush with the side wall of the first mounting slot 151; and the first side wall of the second mounting slot 152, that is near to the back shell 130, is sunken toward the back shell 130 relative to the side wall of the first mounting slot 151; so that the cross-sectional area of the second mounting slot 152 is larger than the cross-sectional area of the first mounting slot 151, namely the space of the second mounting slot 152 is larger than the space of the first mounting slot 151. As shown in FIG. 9, when a part of the clamping part 300 passes through the first mounting slot 151 and is located in the second mounting slot 152, the part of the clamping part 300 could be rotated anticlockwise around the length direction of the watchband 200, so that the clamping part 300 could be clamped in the second mounting slot 152 and prevented from falling off through the first mounting slot 151. In some embodiments, the second mounting slot 152 could also be designed in a structure that allows a part of the clamping part 300 to be rotated clockwise. The structure of the second mounting slot 152 may be not limited as long as a part of the clamping part 300 could be located and rotated in the second mounting slot 152, so that the clamping part 300 could be clamped in the second mounting slot 152.

Figure 10:
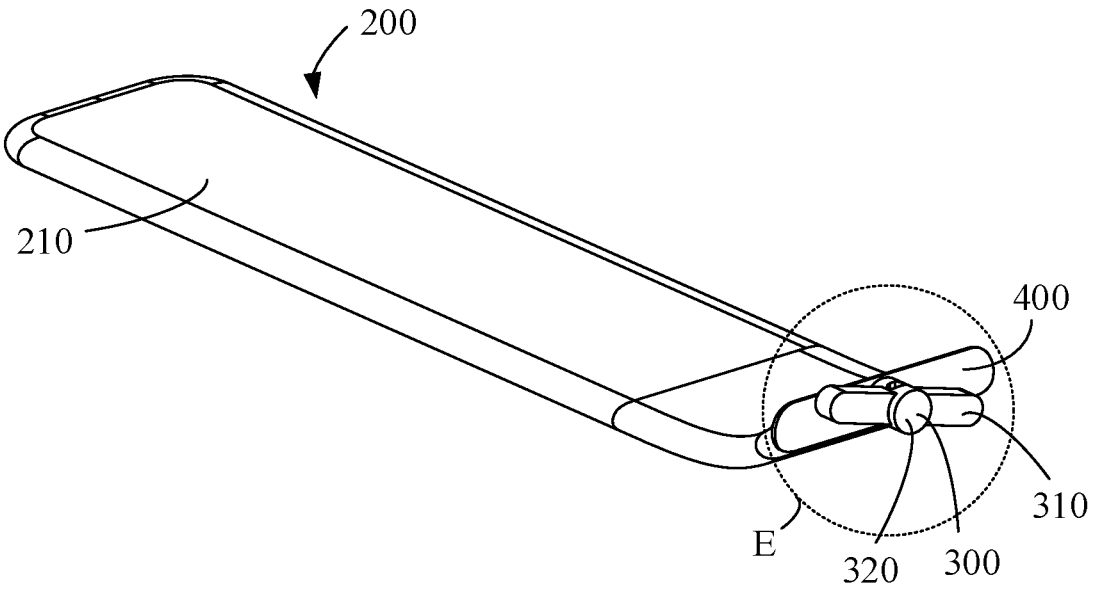
FIG. 10 is a perspective view of a watchband of the wearable device as shown in FIG. 1.
Figure 11:
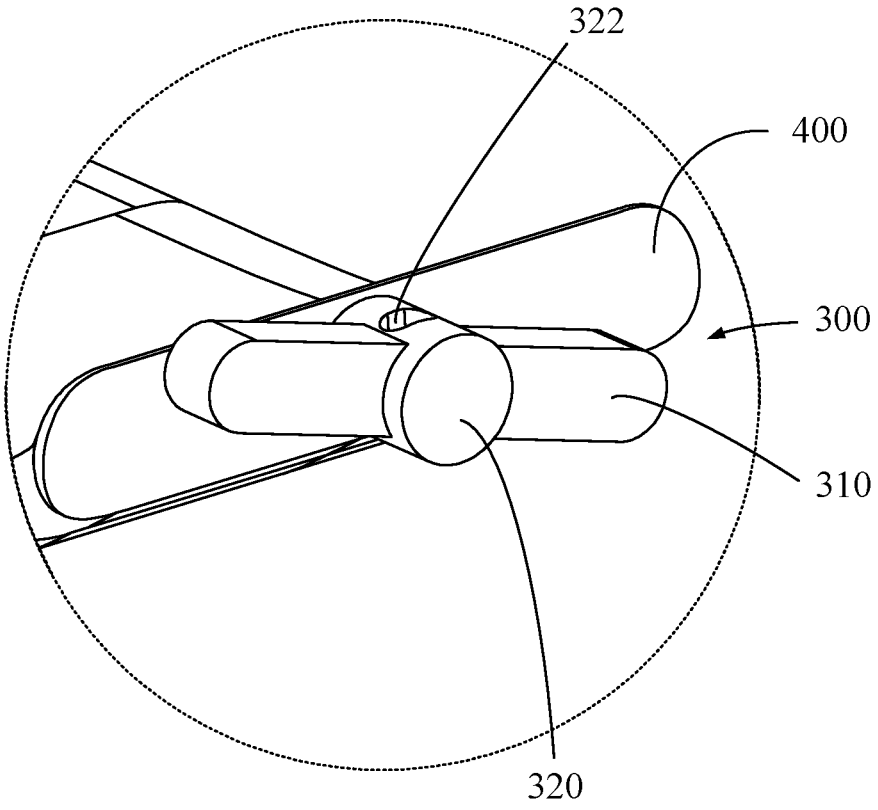
FIG. 11 is an enlarged view of a part E of the watchband as shown in FIG. 10.

As shown in FIG. 10 and FIG. 11, in some embodiments, the clamping part 300 may be fixed on the end of the strap-shaped body 210 and may include a rotating part 320 and a fixing rod 310. The rotating part 320 may be a cylindrical structure and extends along the length direction of the wearable device 10. The fixing rod 310 may be a two-section structure, and the two sections of the fixing rod 310 are fixed on two opposite sides of the rotating part 320 and arranged in a straight line. The fixing rod 310 may be arranged obliquely relative to the strap-shaped body 210, namely, there is an angle between the length direction of the fixing rod 310 and the width direction of the strap-shaped body 210 when the strap-shaped body 210 is unfolded in flattened form. In some embodiments, the angle may be about 16 degrees. The shape and size of the first mounting slot 151 are matched with the fixing rod 310. The watchband 200 may be tilted by rotating around the rotating part 320 when the clamping part 300 is inserted into the mounting slot 15, so that the fixing rod 310 could pass through the first mounting slot 151 and enter the second mounting slot 152. After the fixing rod 310 enter the second mounting slot 152, the strap-shaped body 210 is rotated reversely around the rotating part 320 to be normal stated and parallel with the display screen 110 or the back shell 130, so that the fixing rod 310 is rotated in the second mounting slot 152 relative to the watchcase 100. Thus, the fixing rod 310 is clamped in the second mounting slot 152, and the position of the fixing rod 310 is limited in the second mounting slot 152 along the length direction of the strap-shaped body 210. Since there is an angle between the length direction of the fixing rod 310 and the width direction of the strap-shaped body 210, the end of the watchband 200 could cover the first mounting slot 151 after the watchband 200 is installed on the watchcase 100. Thus, after the watchband 200 is installed on the watchcase 100, the first mounting slot 151 of the wearable device 10 would not be exposed to the user and the wearable device 10 has a better appearance. In some embodiments, there is a distance between the fixing rod 310 and the end of the strap-shaped body 210, so that the fixing rod 310 and the end of the strap-shaped body 210 are spaced apart from each other. The distance between the fixing rod 310 and the end of the strap-shaped body 210 is not less than the dimension of the first mounting slot 151 in the length direction of the wearable device 10. Namely, the distance between the fixing rod 310 and the end of the strap-shaped body 210 is not less than the depth of the first mounting slot 151. When the fixing rod 310 is located in the second mounting slot 152, a part of the rotating part 320 is located in the first mounting slot 151, the first mounting slot 151 is located between the fixing rod 310 and the end of the strap-shaped body 210.

As shown in FIG. 7 and FIG. 11, in some embodiments, the shape and size of the third mounting slot 153 are matched with the rotating part 320. When the clamping part 300 is inserted into the mounting slot 150, the rotating part 320 moves along the side wall of the third mounting slot 153 and toward the interior of the watchcase 100, so that the fixing rod 310 enters the second mounting slot 152. The first mounting slot 151 may be communicated with the key slot 160.

Figure 12:
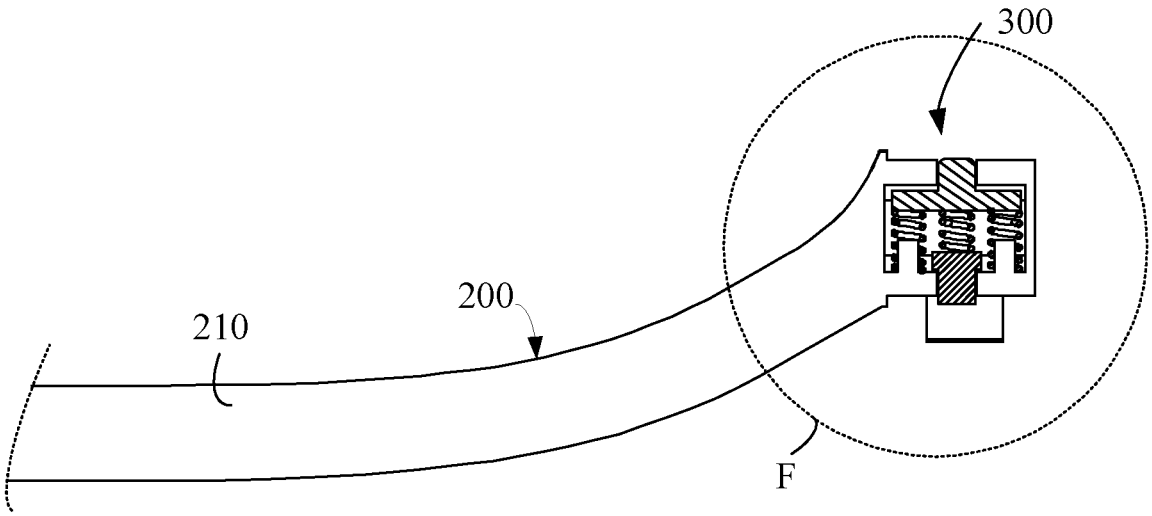
FIG. 12 is a side view of the watchband as shown in FIG. 10, which shows a partial sectional structure of the clamping part along a slotting direction of a first through hole.
Figure 13:
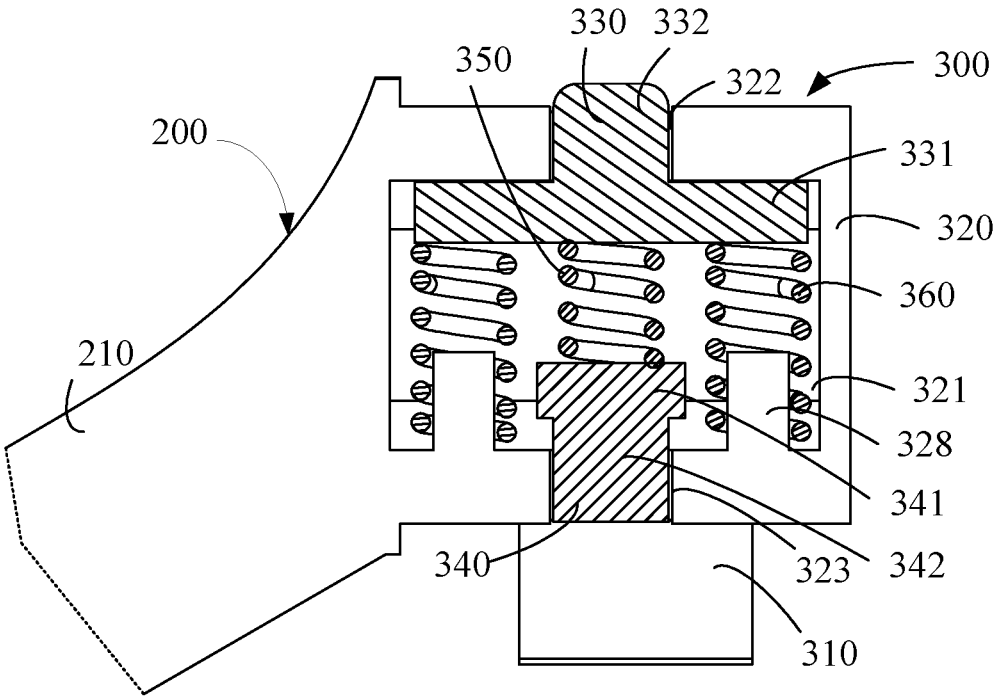
FIG. 13 is an enlarged view of a part F of the watchband as shown in FIG. 12, where the watchband is not connected to the watch.

As shown in FIG. 11 to FIG. 13, in some embodiments, the rotating part 320 defines an accommodation room 321 inside of the rotating part 320. The rotating part 320 further defines a first through hole 322 and a second through hole 323 on the outer surface of the rotating part 320 and communicated with the accommodation room 321. The first through hole 322 and the second through hole 323 are located on the two opposite side surfaces of the rotating part 320 and extend from the outer side surface of the rotating part 320 to the accommodation room 321. It could be understood that the opening of the first through hole 322 faces a first side of the strap-shaped body 210, the opening of the second through hole 323 faces the second side of the strap-shaped body 210 opposite to the first side of the strap-shaped body 210. The axis of the first through hole 322 may be coincidence with or substantially coincidence with the axis of the second through hole 323.

Figure 14:
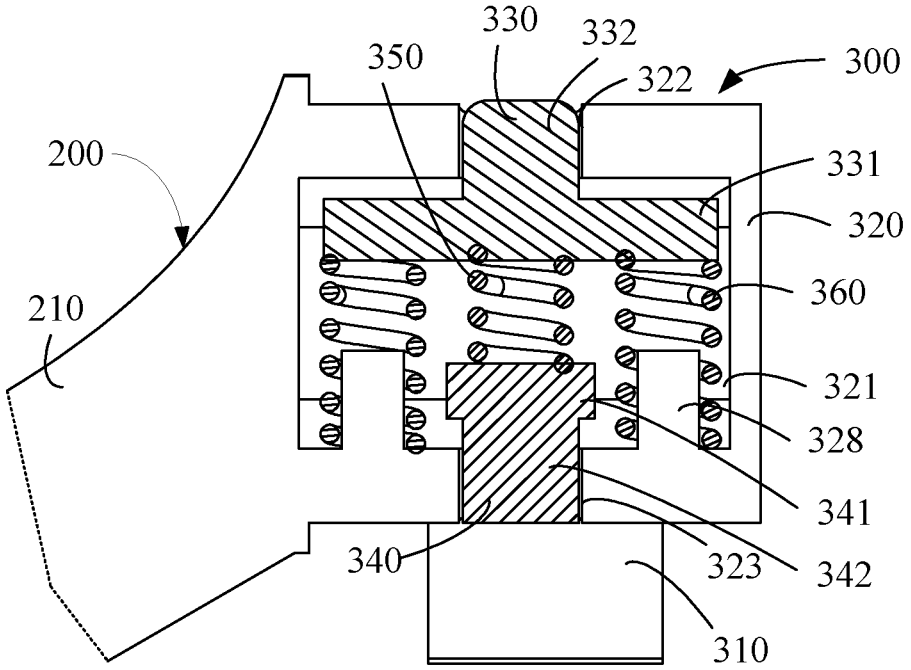
FIG. 14 is an enlarged view of a part F of the watchband as shown in FIG. 12, where the clamping part of the watchband is inserted into the mounting slot and not rotated to be parallel with a display screen.
Figure 15:
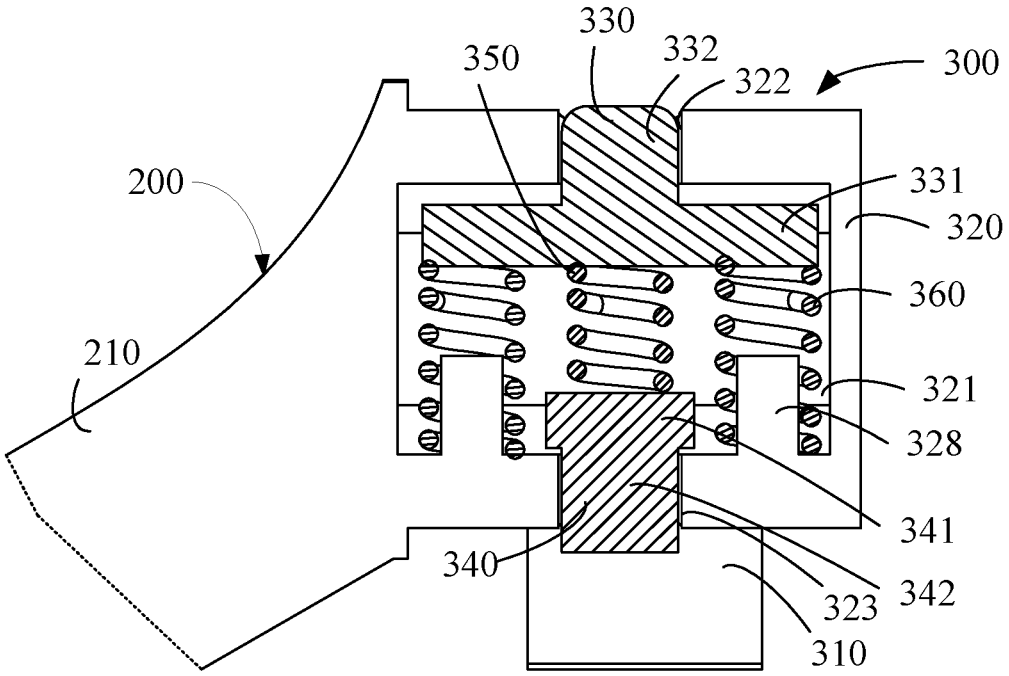
FIG. 15 is an enlarged view of a part F of the watchband as shown in FIG. 12, where the watchband is connected to the watch.
Figure 16:
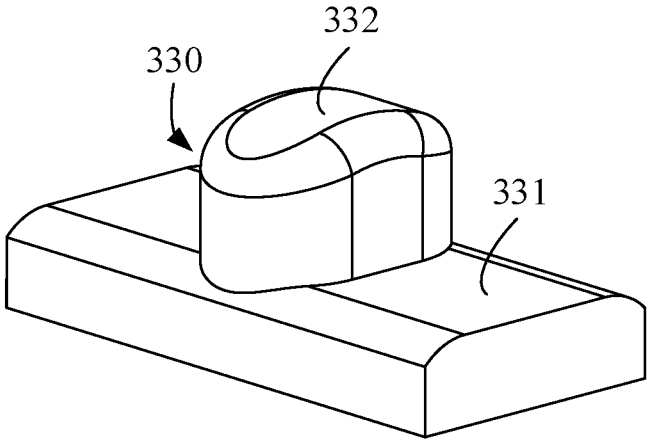
FIG. 16 is a perspective view of a top block of the structure as shown in FIG. 13.
Figure 17:
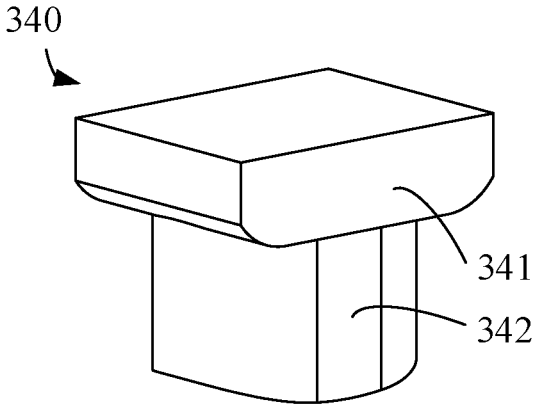
FIG. 17 is a perspective view of a stop block of the structure as shown in FIG. 13.

As shown in FIG. 13 to FIG. 15, in some embodiments, the clamping part 300 further may include a top block 330, a stop block 340, a second elastic unit 350, and a third elastic unit 360. As shown in FIG. 16, the cross section of the top block 330 may be a T-shaped structure, and the top block 330 may include a first base part 331 and a first protruding part 332 fixed on the first base part 331. The first base part 331 may be located in the accommodation room 321, the first protruding part 332 may be located in the first through hole 322 and can move relative to the first through hole 322, so that the free end of the first protruding part 332 can move forward out of the first through hole 322 of the rotating part 320 or move back into the first through hole 322 of the rotating part 320. The free end of the first protruding part 332 that can move out of the first through hole 322 may be a smooth transition structure, so that the free end of the first protruding part 332, that is out of the first through hole 322, can move back into the first through hole 322 in the process of inserting the clamping part 300 into the first mounting slot 151. As shown in FIG. 17, the cross section of the stop block 340 may be a T-shaped structure, and the stop block 340 may include a second base part 341 and a second protruding part 342 fixed on the second base part 341. The second base part 341 may be located in the accommodation room 321, the second protruding part 342 may be located in the second through hole 323 and can move relative to the second through hole 323, so that the free end of the second protruding part 342 can move forward out of the second through hole 323 of the rotating part 320 or move back into the second through hole 323 of the rotating part 320.

As shown in FIG. 13 to FIG. 15, in some embodiments, the rotating part 320 may include a first pillar 328 located in the accommodation room 321. One end of the third elastic unit 360 may be wrapped on the first pillar 328, and the other end of the third elastic unit 360 may be in contact with the top block 330. When the watchband 200 is detached from the watchcase 100, the third elastic unit 360 is in a compression state, so that the third elastic unit 360 drives the first protruding part 332 to penetrate the first through hole 322 and protrude out of the rotation part 320. In some embodiments, the third elastic unit 360 may be a spring. In some embodiments, the number of the first pillars 328 may be two, the number of the third elastic units 360 may be two, and each of the two third elastic units 360 may be wrapped on one of the two first pillars 328. In the length direction of the wearable device 10, the two first pillars 328 are spaced apart from each other and located on two opposite sides of the second through hole 323.

As shown in FIG. 13 to FIG. 15, in some embodiments, one end of the second elastic unit 350 may be in contact with and connected to the top block 330 and the other end of the second elastic unit 350 may be in contact with and connected to the stop block 340. As shown in FIG. 13, when the watchband 200 is not installed on the watchcase 100, the first protruding part 332 of the top block 330 protrudes out of the rotating part 320 under the pushing of the third elastic unit 360, then the second elastic unit 350 pulls the stop block 340, so that the second protruding part 342 moves back into the second through hole 323 of the rotating part 320. It could be understood that when the watchband 200 is detached from the watchcase 100, the free end of the first protruding part 332 protrudes out of the first through hole 322 of the rotating part 320, and the second protruding part 342 is located in the second through hole 323 of the rotating part 320. In the process of inserting the clamping part 300 into the first mounting slot 151, the free end of the first protruding part 332 is compressed by the wall of the third mounting slot 153 and move back into the first through hole 322 of the rotating part 320, so that the first base part 331 push the second elastic unit 350 to drive the second protruding part 342 to move along the second through hole 323 and protrude out of the second through hole 323 of the rotating part 320. It could be understood that when the user wears the wearable device 10, the bending direction of the strap-shaped body 210 may be not limited and could be toward the top block 330 or toward the stop block 340.

Figure 18:
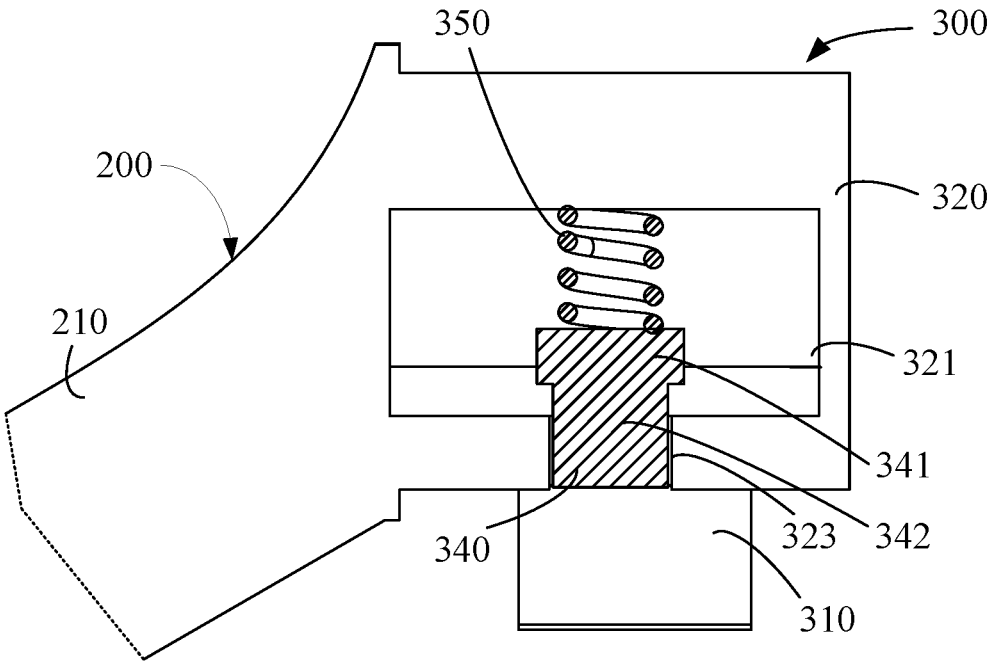
FIG. 18 an enlarged view of a part F of the watchband as shown in FIG. 12 according to other embodiments of the present disclosure, where the watchband is not connected to the watch.
Figure 19:
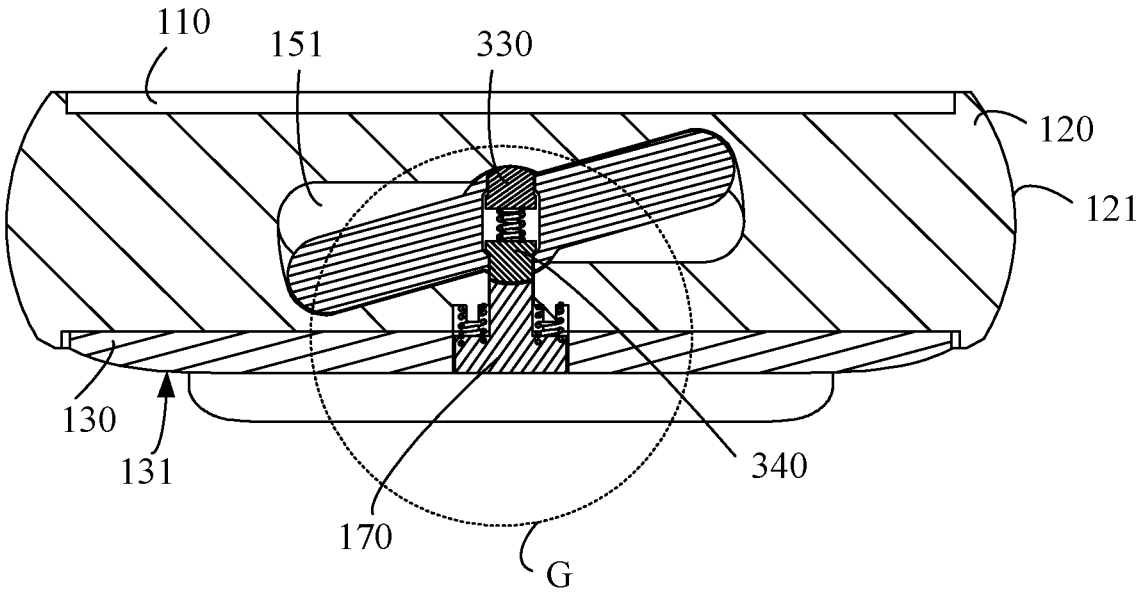
FIG. 19 is a sectional view along line A-A of the wearable device as shown in FIG. 2.

As shown in FIG. 13 to FIG. 15, in some embodiments, in the process of attaching the watchband 200 on the watchcase 100, the watchband 200 is moved along the length direction of the strap-shaped body 210 and rotated around the length direction of the strap-shaped body 210, so that the clamping part 300 could be inserted into the first mounting slot 151. When the clamping part 300 is inserted into the first mounting slot 151, the fixing rod 310 moves along the first mounting slot 151 into the watchcase 100, and the rotating part 320 moves along the third mounting slot 153 into the watchcase 100. As shown in FIG. 14, the first protruding part 332 of the top block 330 is compressed by the side wall of the third mounting slot 153 and move back into the first through hole 322 of the rotating part 320, so that the third elastic unit 360 is compressed by the first base part 331. Thus, the first base part 331 push the second elastic unit 350 to drive the second protruding part 342 to move toward the opening of the second through hole 323. However, the second protruding part 342 cannot protrude out of the second through hole 323 of the rotating part 320 because of the obstruction of the side wall of the third mounting slot 153. As shown in FIG. 15, FIG. 18 and FIG. 19, when the fixing rod 310 just enters the second mounting slot 152, the second protruding part 342 of the stop block 340 and the key slot 160 are misaligned in the width direction of the wearable device 10. The clamping part 300 could be reversely rotated around the length direction of the strap-shaped body 210, so that the second protruding part 342 of the stop block 340 and the key slot 160 are aligned. Thus, the second protruding part 342 could protrude out of the second through hole 323 of the rotating part 320 and be clamped in the key slot 160. At this time, the fixing rod 310 may be further clamped in the second mounting slot 152 and stopped by the wall of the second mounting slot 152, which is close to the first mounting slot 151 and opposite to the bottom wall of the second mounting slot 152 due to the rotation of the clamping part 300. Thus, the fixing rod 310 is prevented from moving from the second mounting slot 152 to the first mounting slot 151 along the length direction of the wearable device 10. Because the cooperation of the stop block 340 and the key slot 160 and the cooperation of the fixing rod 310 and the second mounting slot 152, the watchband 200 could neither rotate nor move along the length direction of the wearable device 10, so that the watchband 200 is installed on the watchcase 100. At the same time, the watchband 200 is rotated around the length direction of the strap-shaped body 210, so that the first mounting slot 151 is covered by the end of the strap-shaped body 210. Thus, the appearance of the wearable device 10 is more beautiful.

In some embodiments, as shown in FIG. 18, the stop block 340 and the second elastic unit 350 are located in the accommodation room 321, and the first through hole 322, the third elastic unit 360, and the top block 330 are omitted. One end of the second elastic unit 350 may be in contact with and connected to the side wall of the accommodation room 321 of the rotating part 320, and the other end of the second elastic unit 350 may be in contact with and connected to the second base part 341. The second protruding part 342 can move forward or back in the second through hole 323. The second elastic unit 350 may be in compression state and drives the second protruding part 342 to protrude out of the rotation portion 320 from the second through hole 323. In the process of installing the watchband 200 on the watchcase 100, the watchband 200 may be moved along the length direction of the watchband 200 and rotated around the length direction of the watchband 200. When the clamping part 300 is close to the first mounting slot 151, the end of the second protruding part 342 that is out of the rotating part 320 is pressed, so that the second protruding part 342 move back into the rotating part 320 and the clamping part 300 can be inserted into the first mounting slot 151. When the clamping part 300 is inserted into the first mounting slot 151, the fixing rod 310 moves along the first mounting slot 151 into the inside of the watchcase 100, and the rotating part 320 moves along the third mounting slot 153 into the inside of the watchcase 100 until the fixing rod 310 enters the second mounting slot 152. The clamping part 300 is reversely rotated around the length direction of the strap-shaped body 210, so that the second protruding part 342 is aligned with the key slot 160, and the end of the second protruding part 342 can be inserted into and clamped in the key slot 160 by protruding out of the rotating part 320. At this time, the fixing rod 310 is clamped by the wall of the second mounting slot 152, that is close to the first mounting slot 151 and opposite to the bottom wall of the second mounting slot 152, due to the rotation of the clamping part 300. Thus the fixing rod 310 is prevented from moving from the second mounting slot 152 to the first mounting slot 151 along the length direction of the wearable device 10. Thus, the watchband 200 is installed on the watchcase 100.

Figure 20:
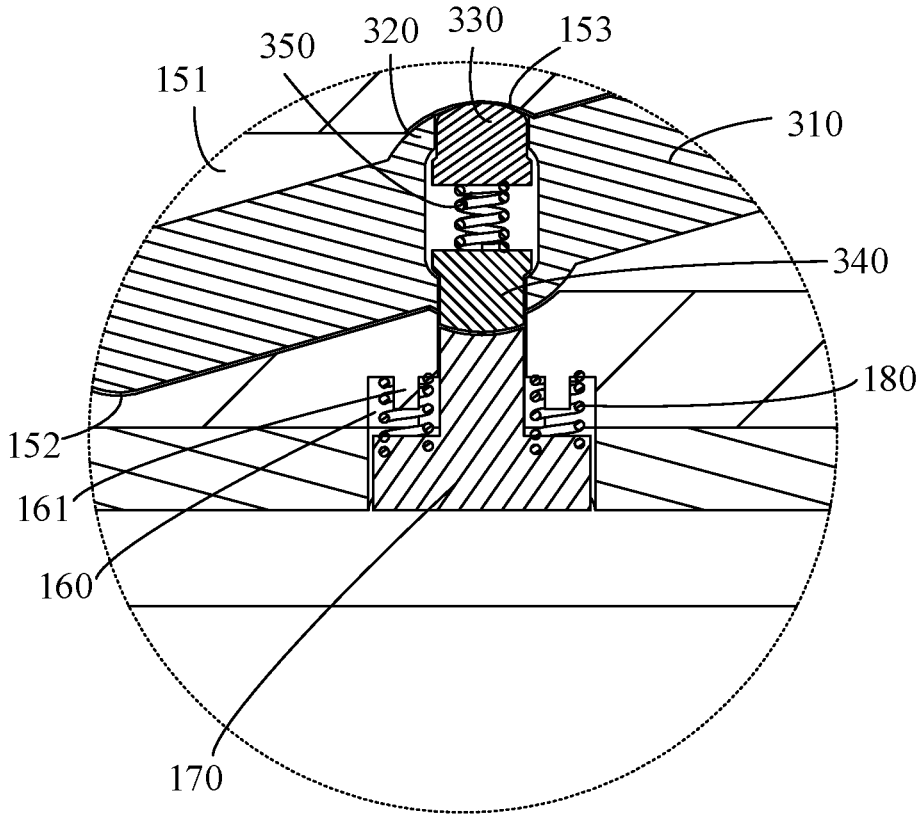
FIG. 20 is an enlarged view of a part G of the structure as shown in FIG. 18.

As shown in FIG. 5, FIG. 19 and FIG. 20, in some embodiments, one end of the key slot 160 extends to the wall of the third mounting slot 153, and the other end of the key slot 160 extends to the rear surface 131 of the back shell 130. The cross section of the key slot 160 may be T-shaped structure, and the cross section of the key 170 may be also T-shaped structure, so that the key 170 matches the key slot 160. The key slot 160 may include a narrow space and a wide space communicated to the narrow space. The key 170 may include a narrow part and a wide part connected to the narrow part. The narrow part may be located in the narrow space and the wide part may be located in the wide space. The key slot 160 may include a second pillar 161 and a first elastic unit 180 wrapped on the second pillar 161. One end of the first elastic unit 180 away from the second pillar 161 may be connected to the key 170. In some embodiments, the number of the second pillar 161 may be two, and the two second pillar 161 are located in the wide space and on opposite sides of the narrow space in the width direction of the wearable device 10. In the process of installing the watchband 200 on the watchcase 100, the key 170 is pressed to move toward the key slot 160, and the first elastic unit 180 is compressed. The narrow part of the key 170 can touch the stop block 340 and press the stop block 340, so that the second protruding part 342 move back into the second through hole 323 of the rotating part 320. Then, the clamping part 300 is rotated, so that the fixing rod 310 can move back, pass through the first mounting slot 151, and exit the mounting slot 150. Thus, the watchband 200 can be detached from the watchcase 100. It could be understood that, when the watchband 200 is installed on the watchcase 100, in a natural state, the outer surface of the wide part of the key 170 is flush with the rear surface 131 of the back case 130. In some embodiments, when the watchband 200 is installed on the watchcase 100, in a natural state, the wide part of the key 170 could also protrude out of the back case 130, or the outer surface of the wide part of the key 170 could be sink in the key slot 160. In some embodiments, the first elastic unit 180 is a spring.

For the wearable device 10 of the present application, the watchcase 100 may include the mounting slot 150 and the key slot 160 may be intercommunicated with each other, and the key 170 is disposed in the key slot 160. One end of the watchband 200 may include the clamping part 300, and the fixing rod 310 of the clamping part 300 can pass through the first mounting slot 151 and get into the second mounting slot 152. The fixing rod 310 could be rotated in the second mounting slot 152, so that the second protruding part 342 could be clamped in the key slot 160 and the clamping part 300 cannot be rotated around the length direction of the wearable device 10. Furthermore, the fixing rod 310 could be clamped in the second mounting slot 152, so that the clamping part 300 is limited and cannot move in the length direction of the wearable device 10. After the watchband 200 is installed on the watchcase 100, the watchband 200 could completely cover the mounting slot 150, so that the wearable device 10 has a better appearance. When the stop block 340 is pressed by pressing the key 170, the stop block 340 could move back into the rotating part 320. The clamping part 300 could be rotated, so that the fixing rod 310 could match the first mounting slot 151 and exit from the first mounting slot 151. Thus, the watchband 200 could be detached from the watchcase 100. It is easy for user to attach the watchband 200 on the watchcase 100 and detach the watchband 200 from the watchcase 100, which could bring better user experience.

The technical features of the embodiments described above can be arbitrarily combined. In order to simplify the description, all possible combinations of the technical features in the above embodiments are not described. However, as long as there is no contradiction in the combination of these technical features, it should be considered as the scope described in this specification.

The above-mentioned embodiments only express several implementation manners of the present application, and their descriptions are specific and detailed, but they do not intend to limit the scope of the present disclosure. It should be noted that, for those of ordinary skill in the art, without departing from the concept of the present application, several modifications and improvements can be made, which all belong to the protection scope of the present application. Therefore, the protection scope of this application patent shall be subject to the appended claims.

What is claimed is:

1. A wearable device, comprising:

a watchcase defining a mounting slot and a key slot communicating with each other;

a watchband comprising:

a strap-shaped body; and a clamping part connected to one end of the strap-shaped body and comprising a rotating part and a stop block arranged in the rotating part;

wherein the stop block is capable of moving out of or back into the rotating part;

when the stop block moves into the rotating part, the clamping part is configured to be inserted into the mounting slot; and after the clamping part is inserted into the mounting slot, the clamping part is configured to be rotated relative to the watchcase by rotating the watchband, and the stop block is configured to move out of the rotating part and is clamped in the key slot, such that the watchband is attached on the watchcase, wherein the watchcase further comprises a side frame comprising an outer surface and defining the mounting slot;

the mounting slot comprises a first mounting slot and a second mounting slot communicating with each other; the first mounting slot extends to the outer surface of the side frame, and the second mounting slot is defined by the bottom of the first mounting slot; and the clamping part further comprises a fixing rod fixed on the rotating part; the rotating part is fixed on the strap-shaped body, and the fixing rod is inclined to a width direction of the strap-shaped body; the fixing rod is configured to enter the second mounting slot by passing through the first mounting slot along a length direction of the strap-shaped body; and after the fixing rod enters the second mounting slot, the watchband is capable of rotating around the length of the strap-shaped body, such that the fixing rod rotates and is limited in the second mounting slot to prevent the watchband from falling off from the second mounting slot.

2. The wearable device as claimed in claim 1, wherein the watchcase comprises a key received in the key slot; and the key is movable relative to the key slot and configured to press the stop block to move out of the key slot, such that the watchband is detached from the watchcase by rotating the watchband after the stop block is accommodated in the rotating part.

3. The wearable device as claimed in claim 2, wherein the watchcase further comprises a first elastic unit arranged in the key slot; one end of the first elastic unit abuts against a side wall of the key slot, and the other end of the first elastic unit abuts against the key; and when the watchband is attached on the watchcase, the key is configured to be pressed to move into the key slot to compress the first elastic unit and push the stop block to move out of the key slot.

4. The wearable device as claimed in claim 1, wherein the mounting slot further comprises a third mounting slot; the third mounting slot is defined by a side wall of the first mounting slot and extends to the outer surface of the side frame; the key slot is communicated with the third mounting slot; and in the process of the fixing rod passing through the first mounting slot and entering the second mounting slot, a part of the rotating part is received in the third mounting slot, and the rotating part is rotatable in the third mounting slot.

5. The wearable device as claimed in claim 4, wherein the clamping part further comprises a second elastic unit received in the rotating part; the second elastic unit is configured to drive the stop block to move out of the rotating part; and the fixing rod is configured to be rotated around the length direction of the strap-shaped body by rotating the watchband, such that the stop block moves out of the rotating part and is accommodated in the key slot, and the fixing rod is clamped by a side wall of the second mounting slot close to the first mounting slot.

6. The wearable device as claimed in claim 4, wherein the clamping part further comprises a top block, a second elastic unit, and a third elastic unit; the top block, the second elastic unit, and the third elastic unit are arranged in the rotating part; one end of the third elastic unit abuts against a wall of the rotating part, and the other end of the third elastic unit abuts against the top block; the third elastic unit is configured to drive the top block to protrude out of the rotating part; one end of the second elastic unit abuts against the top block, and the other end abuts against the stop block; the top block is configured to drive the stop block to move out of or back into the rotating part through the second elastic unit; in the process of the fixing rod passing through the first mounting slot, the side wall of the third mounting slot presses the top block to make the top block move back into the rotating part; and when the fixing rod is received in the second mounting slot, the fixing rod is configured to be rotated around the length direction of the strap-shaped body by rotating the watchband, such that the stop block moves out of the rotating part and is accommodated in the key slot, and the fixing rod is clamped by a side wall of the second mounting slot close to the first mounting slot.

7. The wearable device as claimed in claim 6, wherein the rotating part defines an accommodation room and a first through hole communicated with the accommodation room, the first through hole extends from the accommodation room to an outer surface of the rotating part; and the top block comprises a first base part and a first protruding part connected to the first base; the first base part is accommodated in the accommodation room, and the first protruding part is received in the first through hole and movable in the first through hole, such that an end of the first protruding part moves out of or back into the rotating part through first through hole.

8. The wearable device as claimed in claim 7, wherein the end of the first protruding part capable of moving out of or back into the rotating part through the first through hole has a smooth transition structure.

9. The wearable device as claimed in claim 7, wherein the rotating part further defines a second through hole communicated with the accommodation room and extending from the accommodation room to an outer surface of the rotating part; the first through hole and the second through hole are located on two opposite sides of the rotating part; and the stop block comprises a second base part and a second protruding part connected to the second base part; the second base part is accommodated in the accommodation room, and the second protruding part is received in the second through hole and movable in the second through hole, such that an end of the second protruding part moves out of or back into the rotating part through the second through hole.

10. The wearable device as claimed in claim 7, wherein the rotating part further comprises a first pillar accommodated in the accommodation room, the end of the third elastic unit abutting against the rotating part is wrapped on the first pillar, and the other end of the third elastic unit abuts against the first base part.

11. A watchband, comprising:

a strap-shaped body; and a clamping part defining an accommodation room and connected to one end of the strap-shaped body, wherein the clamping part comprises a fixing rod and a stop block; the fixing rod is inclined with respect to a width direction of the strap-shaped body, the stop block is accommodated in the accommodation room and configured to move out of or back into the accommodation room, wherein the clamping part further comprises a rotating part, a top block, a second elastic unit, and a third elastic unit the rotating part is fixed on the strap-shaped body; the fixing rod is fixed on the rotating part; the accommodation room is defined by the rotating part, and the top block, the second elastic unit, and the third elastic unit are accommodated in the accommodation room; one end of the third elastic unit abuts against a side wall of the rotating part, the other end of the third elastic unit abuts against the top block, the third elastic unit is configured to drive the top block to move out of the accommodation room; and one end of the second elastic unit abuts against the top block, and the other end of the second elastic unit abuts against the stop block, and the second elastic unit is configured to drive the stop block to move out of or back into the rotating part.

12. The watchband as claimed in claim 11, wherein the rotating part further defines a first through hole communicating with the accommodation room; the top block comprises a first base part and a first protruding part connected to the first base part; and the first base part is accommodated in the accommodation room, and the first protruding part is received in the first through hole and movable in the first through hole, such that an end of the first protruding part moves out of or back into the rotating part through the first through hole.

13. The watchband as claimed in claim 12, wherein the rotating part further comprises a second through hole communicating with the accommodation room and extending from the accommodation room to an outer surface of the rotating part; the first through hole and the second through hole are located on two opposite sides of the rotating part; the stop block comprises a second base part and a second protruding part connected to the second base part; and the second base part is accommodated in the accommodation room, and the second protruding part is received in the second through hole and movable in the second through hole, so that an end of the second protruding part moves out of or back into the rotating part.

14. A connector, configured to connect a strap-shaped body to a watchcase of a wearable device, comprising:

a body configured to connect to one end of the strap-shaped body; and a clamping part connected to the body and configured to be inserted into a mounting slot of the watchcase along a length direction of the strap-shaped body;

wherein after the clamping part is inserted into the mounting slot, the clamping part is capable of rotating around the length direction of the strap-shaped body to be clamped in the mounting slot, such that the strap-shaped body is attached on the watchcase by the connector;

wherein the watchcase further defines a key slot communicating with the mounting slot;

wherein the mounting slot comprises a first mounting slot and a second mounting slot communicating with each other, the first mounting slot extends to an outer surface of the watchcase, the second mounting slot is defined by a bottom of the first mounting slot, and a cross-sectional area of the second mounting slot is larger than a cross-sectional area of the first mounting slot;

wherein the clamping part comprises:

a rotating part fixed on the strap-shaped body;

a fixing rod fixed on the rotating part and is inclined with respect to a width direction of the strap-shaped body, wherein the fixing rod is configured to move along the length direction of the strap-shaped body and enter the second mounting slot by passing through the first mounting slot; and a stop block arranged on the rotating part, wherein the stop block is configured to move relative to the rotating part; and wherein when the fixing rod is received in the second mounting slot, the clamping part is capable of rotating around the length direction of the strap-shaped body, such that the fixing rod is limited in the second mounting slot along the length direction of the strap-shaped body, and the stop block protrudes from the rotating part and is clamped in the key slot.

15. The connector as claimed in claim 14, wherein the mounting slot further comprises a third mounting slot; the third mounting slot is defined by a side wall of the first mounting slot and extends to the outer surface of the watchcase; the key slot is defined by a side wall of the third mounting slot and communicated to the third mounting slot; and when the fixing rod is received in the second mounting slot and the clamping part rotates around the length direction of the strap-shaped body, the rotating part is rotated in the third mounting slot;

wherein the clamping part comprises a second elastic unit arranged on the rotating part; the second elastic unit abuts against the stop block and is configured to drive the stop block to move to protrude out of the rotating part; the stop block is capable of moving back into the rotating part, such that the fixing rod is inserted to the second mounting slot by passing the first mounting slot; and the fixing rod is rotated around the length direction of the strap-shaped body by rotating the clamping part, such that the stop block protrudes out of the rotating part and is accommodated in the key slot, and the fixing rod is clamped by a side wall of the second mounting slot close to the first mounting slot.

16. The connector as claimed in claim 14, wherein the mounting slot further comprises a third mounting slot; the third mounting slot is defined by a side wall of the first mounting slot and extends to the outer surface of the watchcase; the key slot is defined by a side wall of the third mounting slot and communicated to the third mounting slot; and when the fixing rod is received in the second mounting slot and the clamping part rotates around the length direction of the strap-shaped body, the rotating part is rotated in the third mounting slot;

wherein the clamping part comprises a top block, a second elastic unit, and a third elastic unit; the top block, the second elastic unit, and the third elastic unit are arranged on the rotating part; one end of the third elastic unit abuts against a wall of the rotating part, and the other end of the third elastic unit abuts against the top block, the third elastic unit is configured to drive the top block to protrude out of the rotating part; one end of the second elastic unit abuts against the top block, and the other end of the second elastic unit abuts against the stop block; the top block is configured to drive the stop block to move through the second elastic unit, so that the stop block moves out of or back into the rotating part; when the fixing rod passes through the first mounting slot, the side wall of the third mounting slot presses the top block, so that the top block moves back into the rotating part and pushes the stop block through the second elastic unit; and when the fixing rod is received in the second mounting slot, the fixing rod is configured to be rotated around the length direction of the strap-shaped body by rotating the clamping part, so that the stop block protrudes out of the rotating part and is accommodated in the key slot, and the clamping part is clamped by the side wall of the second mounting slot close to the first mounting slot.

* * * * *